US005429309A

United States Patent [19]

Stockner

[11] Patent Number: 5,429,309

[45] Date of Patent: Jul. 4, 1995

[54] FUEL INJECTOR HAVING TRAPPED FLUID VOLUME MEANS FOR ASSISTING CHECK VALVE CLOSURE

[75] Inventor: Alan R. Stockner, Metamora, Ill.

[73] Assignee: Caterpillar Inc., Peoria, Ill.

[21] Appl. No.: 239,071

[22] Filed: May 6, 1994

[51] Int. Cl.[6] ..... F02M 47/00

[52] U.S. Cl. ..... 239/533.8; 239/88

[58] Field of Search ..... 239/533.8, 533.9, 88, 239/9, 92; 251/129.1, 57, 30.01

[56] References Cited

U.S. PATENT DOCUMENTS

| | | | |
|---|---|---|---|
| 3,738,576 | 6/1973 | O'Neill | 239/533.8 |
| 3,910,503 | 10/1975 | Barber | 239/533.8 |
| 4,275,844 | 6/1981 | Grgurich et al. | 239/533.3 |
| 4,566,635 | 1/1986 | Trachte | 239/533.9 |
| 4,605,166 | 8/1986 | Kelly | 239/96 |
| 4,889,288 | 12/1989 | Gaskell | 239/533.9 |
| 5,121,730 | 6/1992 | Ausman et al. | 123/467 |
| 5,143,291 | 9/1992 | Grinsteiner | 239/88 |
| 5,191,867 | 3/1993 | Glassey et al. | 123/446 |
| 5,287,838 | 2/1994 | Wells | 123/467 |

*Primary Examiner*—Andres Kashnikow
*Assistant Examiner*—Christopher G. Trainor
*Attorney, Agent, or Firm*—Kevin M. Hinman

[57] ABSTRACT

An improved fuel injector nozzle employs a hydraulic spring which controls displacement of a needle check to provide a desired rate of fuel flow through an injector orifice.

2 Claims, 4 Drawing Sheets

FUEL INJECTOR HAVING TRAPPED FLUID VOLUME MEANS FOR ASSISTING CHECK VALVE CLOSURE

TECHNICAL FIELD

The present invention relates generally to fuel injectors and, more particularly, to high pressure fuel injector nozzles.

BACKGROUND ART

Examples of high pressure fuel injection systems are shown in U.S. Pat. No. 4,275,844 issued to Grgurich et al. and U.S. Pat. No. 5,191,867 issued to Glassey et al. on Mar. 9, 1993. Engines equipped with high pressure fuel injection systems have an optimal volumetric injection rate. For diesel-cycle engines, this optimal injection rate has a gradual rise, a period of stabilization, followed by a sharp drop. Means of producing this characteristic profile are commonly referred to as rate shaping means or devices because they are used to shape the volumetric rate of fuel injection into an engine combustion chamber. The gradual rise followed by a sharp drop in fuel injection has the specific benefit of minimizing particulate emissions from combustion. It also minimizes combustion noise.

Fuel injector nozzles typically include a housing with an elongated cavity or void along a first axis. The cavity has a first end portion or injection chamber and a second end portion or spring chamber with a connecting guide passage disposed therebetween. An injection orifice fluidly connects the injection chamber of the cavity with an atmosphere (e.g., engine combustion chamber) external to the fuel injector. A needle check is slidably disposed within the cavity for translation between a first position in which a seat portion of the needle check seats against a first end or bottom of the cavity, the injection orifice and a second position wherein the needle is spaced from the first end and does not block the injection orifice.

In the fuel injector nozzle of Glassey et al., a spring is disposed against the needle check which tends to bias the needle toward the first end. The spring chamber of the cavity has an opening providing fluid communication with a low pressure fuel supply. Pressurized fuel directed to the injection chamber of the cavity overcomes the spring to move the check away from the first end. Any fluid in the spring chamber of the cavity displaced by movement of the check theretoward is exhausted through the opening connecting to the low pressure fuel supply.

The fuel injector nozzle disclosed by Grgurich does not have a fluid communication opening in the spring chamber. During an injection cycle, fluid seeps past the guide portion of the needle check from the high pressure injection chamber to the spring chamber, increasing the pressure within the spring chamber. The increase in pressure in the spring chamber of the cavity increases the valve opening pressure (VOP) of fluid in the injection chamber needed to lift the check from the first end of the cavity. Too high of a VOP produces a very steep initial rate of fuel injection which has the undesirable effect of increasing engine combustion noise and increasing nitrogen oxides ($NO_x$).

It is desired to provide a fuel injector nozzle having a relatively low VOP and providing a gradually rising volumetric rate of injection with a crisp end of injection to provide a low valve opening pressure, and to minimize engine combustion noise and $NO_x$.

DISCLOSURE OF THE INVENTION

In one aspect of the present invention, a fuel injector nozzle is disclosed comprising a housing defining an elongated cavity with a first end portion having at least one injection orifice and a second end portion and a supply passage communicating pressurized fluid from a fuel pump chamber to the first end portion of the cavity. The nozzle also includes a needle check slidably disposed within the elongated cavity for translation therein between a first position and a second position and having a guide portion sized to provide a minimal annular clearance with the elongated cavity thereby substantially preventing fluid communication between the first end portion of the elongated cavity with the second end portion of the elongated cavity. The needle check has a seat portion defining an area of engagement with a first end of the cavity with the area of engagement being smaller than a cross-sectional area of the guide portion and covering the injection orifice in the first position. A volume of liquid trapped in the second end portion of the cavity is pressurized in response to the displacement of the needle check away from the first end of the cavity by an application of pressurized fluid to the first end portion of the cavity chamber.

The present invention provides a predetermined trapped volume of fuel serving as a hydraulic spring within a spring cavity of a fuel injector housing. This provides a gradually increasing volumetric rate of fuel injection followed by a steep drop-off in the volume of fuel injected as a function of time. The trapped volume of fuel is pressurized by displacement of the needle check away from the first end portion by the force of a pressurized injection charge acting on the check. The resultant pressure in the spring chamber returns the needle check to a closed position very rapidly. Little or no residual pressure is retained in the spring chamber at the end of injection.

BEST MODE FOR CARRYING OUT THE INVENTION

Figure 1:
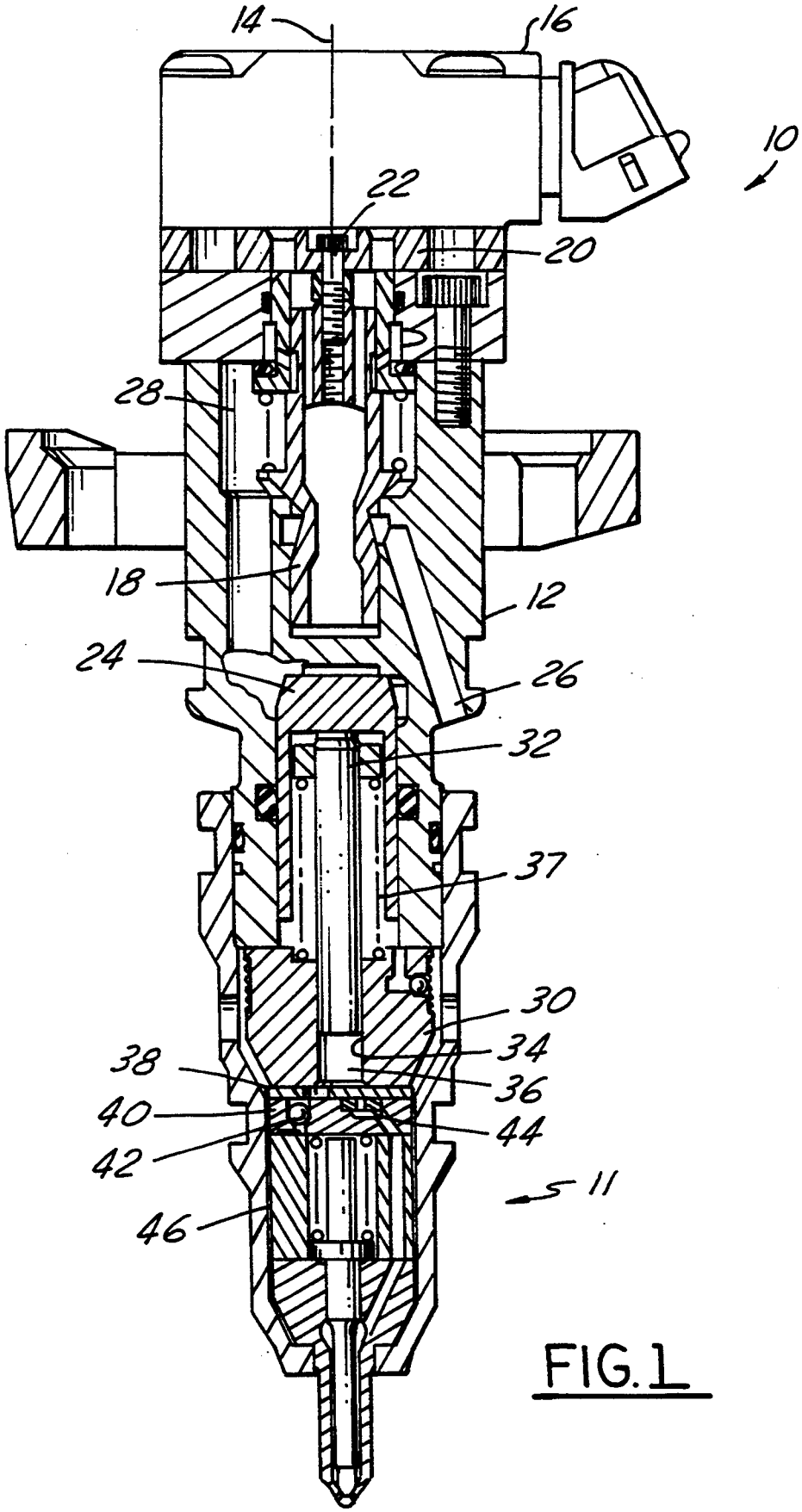
FIG. 1 is a diagrammatic cross-sectional view of one embodiment of a unit fuel injector.

An exemplary fuel injector such as a hydraulically-actuated electronically-controlled unit fuel injector 10, hereinafter referred to as a HEUI fuel injector is shown in FIG. 1. Although shown here as a unitized, or unit fuel injector, the injector could alternatively be of a modular construction with, for example, a nozzle assembly 11 separate from a fuel pressurization unit. Additionally, the means of actuating the fuel pumping mechanism of the injector 10 could be a mechanical system instead of the HEUI system illustrated.

The fuel injector 10 of FIG. 1 has an injector body 12 with a central longitudinal axis 14. A solenoid actuator 16 is mounted over an upper end portion of the injector body 12. A poppet valve 18 is slidably disposed in the body 12 for operable movement between first (non-injection) and second (injection) positions. The poppet valve 18 is fixed to a movable armature 20 of the solenoid actuator 16 by an intermediate threaded fastener 22. The solenoid actuator 16 operably displaces the poppet valve 18 between the first position and the second position in response to electronic signals sent to the solenoid 16 by an electronic control module (not shown).

An intensifier piston 24 is slidably disposed in the body 12 for axial displacement therein. A hydraulic fluid inlet passage 26 communicates highly pressurized hydraulic fluid to the poppet valve 18 from a high pressure manifold (not shown). Internal hydraulic fluid passages 28 communicate hydraulic fluid from the poppet valve 18 to the intensifier piston 24 when the poppet valve 18 is at its second (upward) position.

Figure 2:
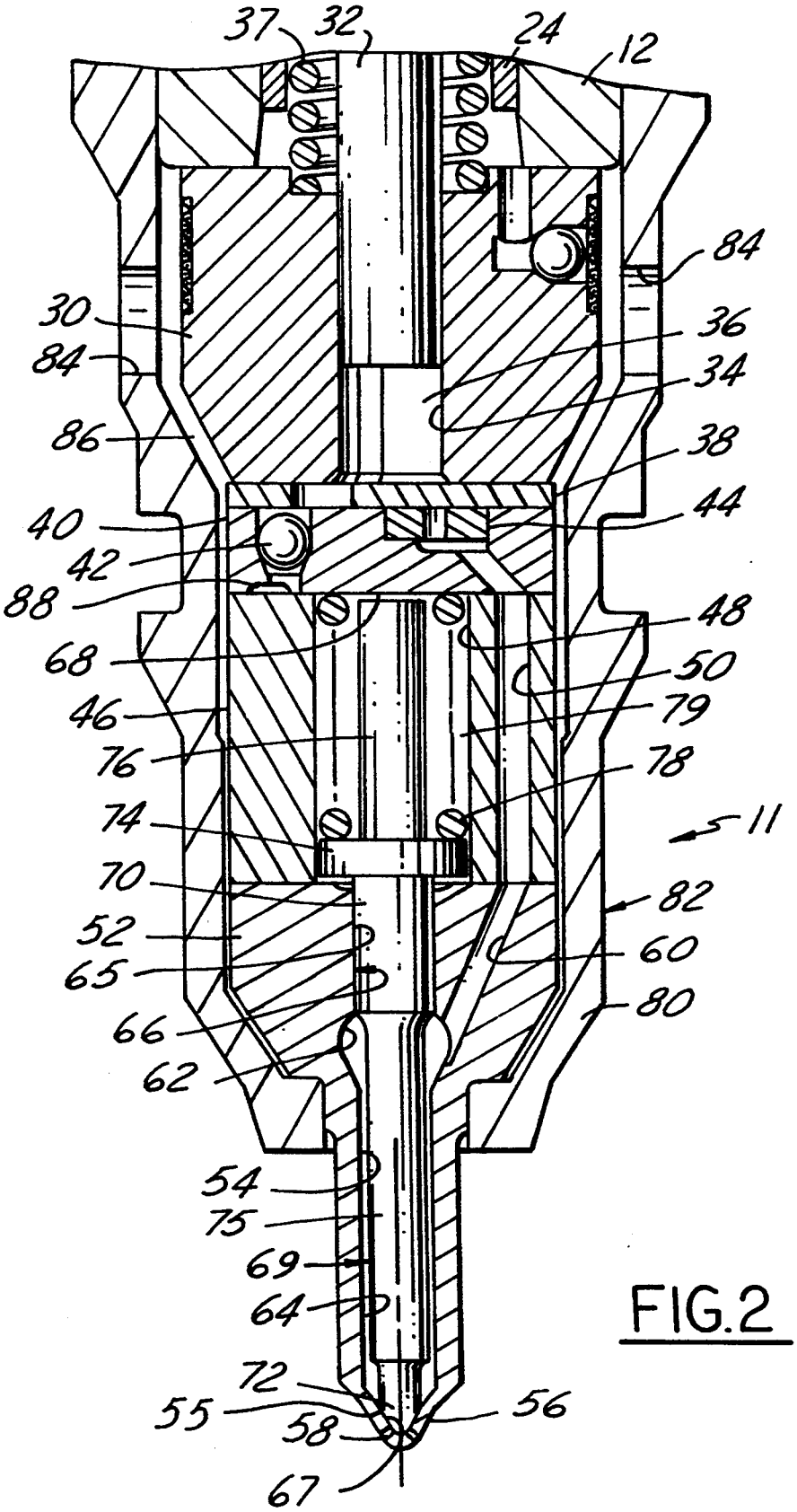
FIG. 2 is a diagrammatic cross-sectional view of a nozzle area of the unit fuel injector of FIG. 1.

A lower end portion of the injector body 12 abuts a barrel assembly 30. A reciprocal fuel pump plunger 32 extends from the piston 24 downward into an axial bore 34 of the barrel assembly 30. A fuel pumping chamber 36 is defined by a portion of the barrel bore 34 at one end portion of the plunger 32. A plunger return spring 37 biases the plunger 32 and intensifier piston 24 upward according to FIGS. 1 and 2.

Beneath the barrel assembly 30 is the nozzle assembly 11. An intermediate spacer plate 38 defines an inlet aperture and one or more separate outlet apertures therethrough. A stop 40 is disposed beneath the intermediate spacer plate 38. A first or ball-type inlet check valve 42 in the stop is in fluid communication with the inlet aperture of the intermediate plate 38 and allows fluid flow there past into the fuel pumping chamber 36. A second or reverse flow check valve 44 in the stop permits fluid flow therepast from the fuel pumping chamber 36, but blocks the return of fluid or combustion gas into the fuel pumping chamber 36. These features are more clearly seen in FIG. 2 and U.S. Pat. No. 5,287,939 issued to Wells on Feb. 22, 1994.

A cylindrical sleeve 46 is disposed beneath the check stop 40. The sleeve 46 defines both a central spring chamber 48 therethrough and a separate discharge passage 50, or fuel injection passage, in fluid communication with the second check valve 44.

A nozzle spray tip 52 abuts the sleeve 46 opposite the stop 40. An axially extending blind bore 54 extends from the spring chamber 48 of the sleeve to a bottom 55 of the bore 54 in an end portion 56 of the tip 52. One or more fuel injection spray orifices 58 are defined in the end portion 56 of the tip 52. A discharge passage 60, or fuel injection passage, of the tip 52 communicates fluid from the discharge passage 50 of the sleeve 46 to a cardioid section 62 of an injection chamber 64 of the blind bore 54. A cylindrical guide passage 65 of the blind bore 54 is disposed between the cardioid section 62 and the spring chamber 48. The stop 40, the sleeve 46, and the spray tip 52 can be referred to collectively as a guiding member. The spring chamber 48 and the blind bore 54 can together be characterized as a single elongated cavity 66 or void extending concentrically along the axis 14. A first end 55 of the elongated cavity 66 is coincident with the bottom 55 of the bore 54. A second end 68 of the elongated cavity 66 is at the stop 40, facing the spring chamber 48. The spring chamber 48 is sealed, being open only at the annular clearance defined between the guide passage 65 and a movable needle check 69. The injection chamber 64 is alternatively characterized as a first end portion 64 of the elongated cavity 66, and the spring chamber 48 as a second end portion 48 of the elongated cavity 66.

The needle check 69 is slidably disposed in the elongated cavity 66 for axial translation between a first or closed position and a second or opened position. The needle check 69 has a guide portion 70 sized to provide a minimum annular clearance with the guide passage 66. A seat portion 72, or first end portion of the needle check 69 defines a surface area of engagement with the bottom 55 of the bore 54, an axial projection of which is smaller than a cross-sectional area of the guide portion 70. Preferably, the seat portion 72 of the needle check 69 covers the fuel injection spray orifices 58 when the check 69 is disposed in the first position. A spring seat 74 of the needle check 69 is disposed in the spring chamber 48. The spring seat 74 is larger in diameter than the guide portion 70, extending radially almost the full diameter of the spring chamber 48.

An intermediate portion 75 of the needle check 69 between the guide portion 70 and the seat portion 72 is of a diameter smaller than that of the guide portion 70. A travel limit portion 76 of the needle check 69 axially extends from the spring seat portion 74 opposite the guide portion 70. The travel limit portion 76 extends to a location proximate to the check stop 40. A helical compression spring 78 is disposed in the spring chamber 48 between the spring seat portion 74 and the check stop 40. The spring 78 biases the seat portion 72 against the bottom 55 of the bore 54. Fluid in the spring chamber 48 acts as a hydraulic spring 79.

A casing 80 such as an internally-threaded nut encases a lower portion of the injector body 12, the barrel assembly 30, the intermediate plate 38, the check stop 40, the sleeve 46, and the tip 52 to maintain them in an operating relationship with respect to one another. Together the stop 40, the sleeve 46, the tip 52, and the casing 80 can be characterized as a nozzle housing 82.

The casing 80 has one or more fuel inlet openings 84 passing therethrough approximately normal to the axis 14. The casing 80 defines an annular fuel passage 86 between itself and the barrel assembly 30 and the stop 40 fluidly connected to the fuel inlet openings 84. An edge filter passage 88 in the stop 40 extends from the annular fuel passage 86 to the first inlet check valve 42.

Industrial Applicability

In operation, hydraulic fluid enters the fluid inlet passage 26 at a pressure, for example, up to 23 MPa (3335 psi). In the first (downward) position, the poppet valve 18 blocks the further advance of the pressurized fluid into the injector body 12. In the first position, the poppet valve also keeps the internal hydraulic fluid passages 28 filled with hydraulic fluid at a relatively lower fluid pressure.

An electronic signal from a controller (not shown) causes the solenoid actuator 16 to displace the armature 20 upward, moving the poppet valve 18 to the second (upward) position. When the poppet valve 18 moves to the second position, the pressure of the fluid in the internal hydraulic fluid passages 28 rapidly increases to that of the fluid in the inlet passage 26 almost instantly. The pressure of the hydraulic actuating fluid acts against the intensifier piston 24, forcing it and the plunger 32 downward against the spring 37.

A low pressure fuel pump (not shown) supplies fuel to the inlet openings 84 through a fuel rail or manifold defined in an engine cylinder head (not shown). Low pressure fuel enters the annular fuel passage 86 through the inlet openings 84, surrounding the barrel assembly 30 and the stop 40. Fuel passes from the annular passage 86, through the edge filter passage 88, past the first check valve 42, and into the fuel pumping chamber 36. The low pressure fuel passes from the pumping chamber 36, through the second check valve 44, through the fuel injection passages 50 and 60 of the sleeve and needle respectively, and to the injection chamber portion 64 of the blind bore 54. Even though the annular clearance between the guide passage 65 and the guide portion 70 is so small as to prevent migration of low pressure fuel to the spring chamber 48, substantially all open volume within the spring chamber 48 not occupied by the needle check 69 and the spring 78 is filled with fuel at low pressure. The fuel therein has accumulated from previous operating cycles, or is provided by prefilling the spring chamber with fuel when assembling the injector 10. Preload pressure of the fuel within the spring chamber 48, that is, pressure in the spring chamber 48 in excess of pressure in the injection chamber 64, is essentially zero when the check 69 is in the first position. This helps provide the desired low VOP by minimizing initial resistence against upward movement of the check 69.

The hydraulic pressure acting against the intensifier piston 24 generates a force which is reacted against by the fuel within the fuel pumping chamber 36. That force is equal to the force on the intensifier piston 24 less that of the spring 37. As the spring 37 is of relatively low load characteristics, the reaction force provided by the fuel in the pumping chamber 36 will nearly equal the force against the intensifier piston 24 applied by the hydraulic actuating fluid. The fuel in the fuel pumping chamber 36 is therefore pressurized to a level approximately equal to the pressure of the hydraulic actuating fluid times the effective cross-sectional area of the intensifier piston 24 divided by the effective cross-sectional area of the plunger 32. An exemplary ratio of areas is approximately seven, resulting in a fuel pressure of approximately 161 MPa (23,350 psi) when the hydraulic pressure is 23 MPa (3335 psi). The highly pressurized fuel in the pumping chamber 36 is in fluid communication with the fuel in the fuel injection passages 50, 60 and the injection chamber 64 and is pressurized very rapidly.

The now highly pressurized fuel in the injection chamber 64 acts against the needle check 69 on an area equal to a cross-section of the guide portion 70 minus a seating area defined by the engagement between the seat portion 72 of the check 69 and the bottom 55 of the bore 54, or first end 55 of the cavity 66. The resultant force against the check 69 causes it to move upward, overcoming the spring 78 and compressing the fuel within the spring chamber 48 by axial entry thereinto. This compression of the fluid within the spring chamber 48, that is compression of the hydraulic spring 79, induces a change in pressure (dP) within the spring chamber 48 equal to the bulk modulus of elasticity of the fluid ($E_b$) multiplied by the change in volume (dV) and divided by the original volume ($V_0$) or in equation form, $dP=E_b(dV/V_0)$. As there is very minimal leakage from the spring chamber 48, the pressure therein continues to build with further displacement of the needle check 69. When the needle check 69 is forced from the first end 55 of the cavity 66, the highly pressurized fuel also acts against the seat portion 72, further increasing the upward force against the check 69. When the check 69 lifts away from the first end 55 of the cavity 66, fuel also begins to pass through the injection orifices 58 and into the engine combustion chamber (not shown). The preselected pressure at which the check 69 first lifts is known as the valve opening pressure (VOP). Fuel discharge begins when the valve opening pressure is reached. Optimally for the injector illustrated, the fuel injector 10 has a relatively low VOP to unseat the check 69, followed by a gradually rising rate of volumetric flow through the injection orifices 58 and followed by a sharp drop in volumetric flow rate to the end of injection. A low VOP combats ignition delay by providing an earlier flame time.

On initial displacement, the check 69 need only overcome the force of the spring 78, providing a relatively low VOP. Fuel in the spring chamber 48 is at substantially near zero residual preload pressure, that is pressure in the spring chamber is near equal to pressure in the injection chamber. The fuel disposed in the spring chamber 48 resultantly provides little resistance to the initial upward displacement of the needle check 69. Continued upward displacement of the needle check 69, however, rapidly increases the pressure of the fluid therein. Providing the spring chamber 48 with a preselected relatively low volume capacity, and the check 69 with a relatively large cross-sectional area guide portion 70, facilitates developing relatively high levels of pressure, or return force, within the spring chamber 48 with only a small amount of axial displacement of the check 69. The original volume ($V_0$) is minimized and the change in volume (dV) for a given axial displacement is maximized.

When the upward moving check 69 contacts the stop 40, the pressure within the spring chamber 48 effectively plateaus. However, as long as there is sufficient annular clearance between the guide portion 70 of the check 69 and the guide passage 65 to allow sliding movement therebetween, that there will be some migration of high pressure fuel from the injection chamber 64 to the spring chamber 48. Much of the pressure will be lost in the movement along the guide passage 65 though, having little or no effect on pressure within the spring chamber 48. For this reason, when the spring 78 returns the check 69 to its original seated position at the end of injection, there is effectively little or no residual preload pressure within the spring chamber 48. Residual preload pressure in the spring chamber 48 has the undesired affect of increasing the VOP. If there is any significant leakage of fuel from the injection chamber 64 into the spring chamber 48 inducing preload, this can be corrected by a design change increasing the length of the guide portion 70 and guide passage interface 65 and/or decreasing the annular clearance to further increase the pressure drop thereacross.

At the end of fuel injection, when the high pressure of fuel in the pumping chamber 36 has been relieved, and the pressure within the injection chamber 64 drops, the pressurized fuel within the spring chamber 48, together with the spring, act to quickly return the check 69 to the first position, providing the desired rapid termination of volumetric flow through the injection orifices 58.

Figure 3:
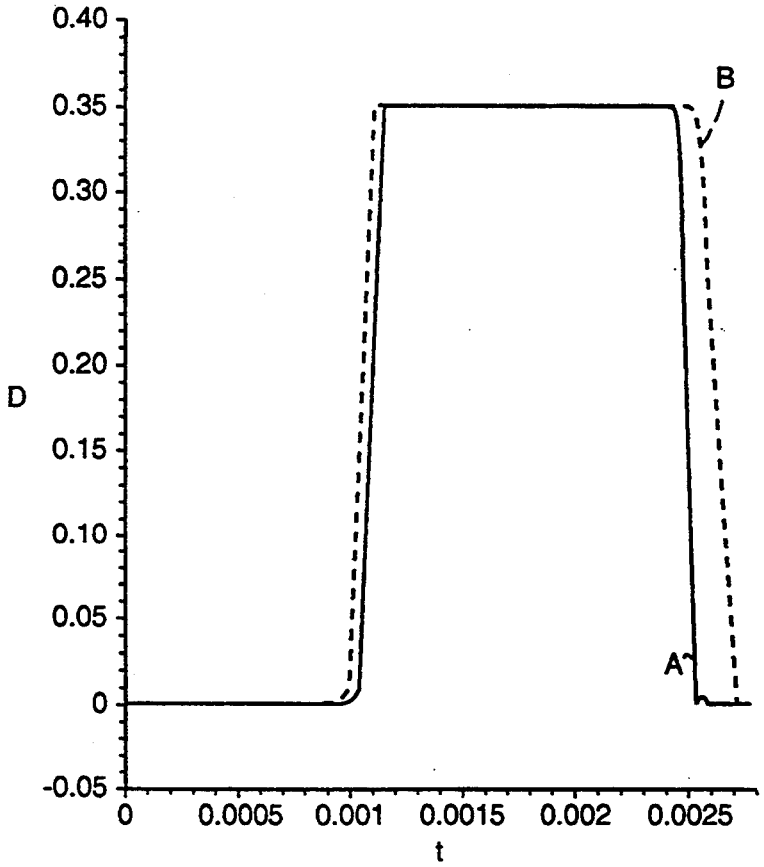
FIG. 3 is a plot of needle check displacement, D, as a function of time, t, for the present invention.
Figure 4:
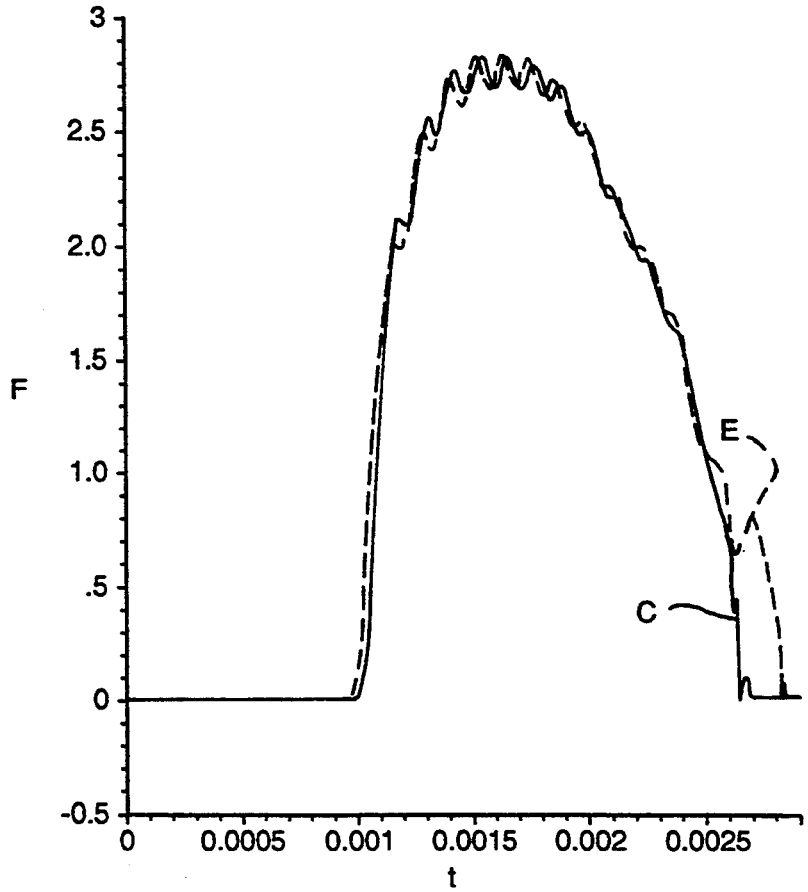
FIG. 4 is a plot of volumetric flow rate, F, from the injector as a function of time, t, for the present invention.
Figure 5:
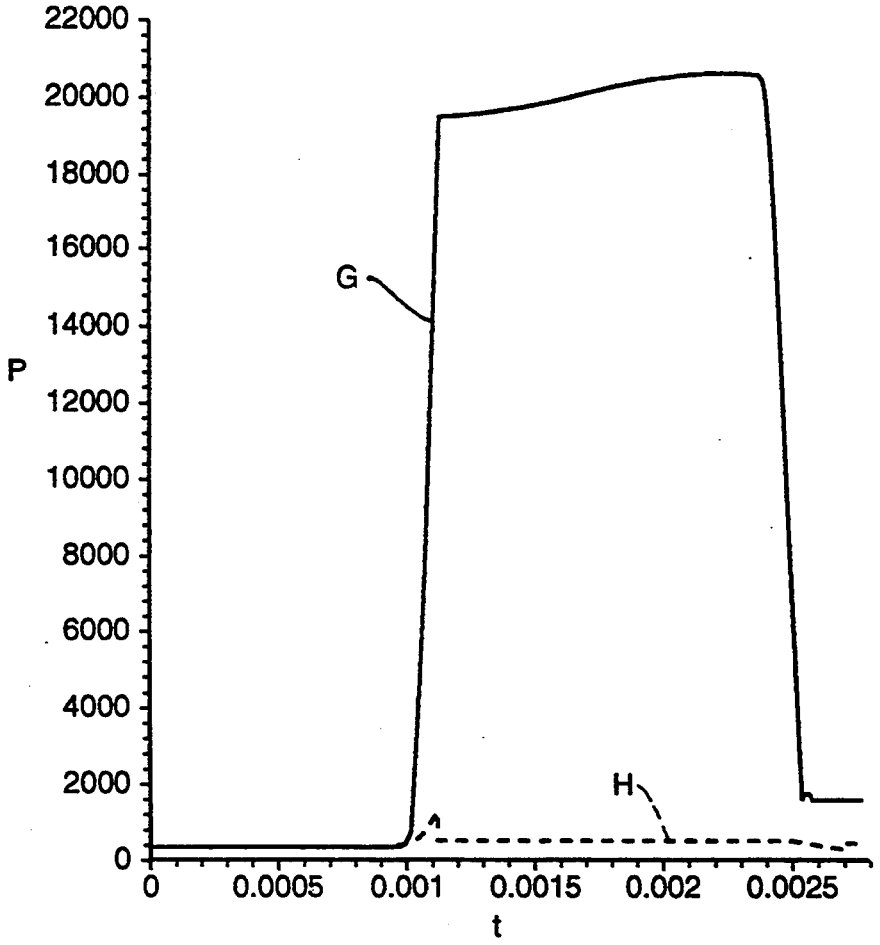
FIG. 5 is a plot of fuel pressure, P, as a function of time, t, for an injection cycle of the present invention.

Volumetric flow rate of fuel through the injector orifices 58 is a function of both orifice geometry, and of the distance of the check seat portion 72 from the first end 55 of the cavity 66, as this distance serves as a restriction of fuel flow reaching the orifices 58. The further the seat portion 72 gets from the first end portion, the greater the volumetric rate of flow through the orifices 58 will be. FIGS. 3, 4 and 5 show, respectively, plots of check displacement D, volumetric flow rate F, and pressure P, each as a function of time t. FIGS. 3, 4 and 5 each have an exemplary plot simulating the variation of those characteristics over time, t, measured in seconds, for the present invention as well as a baseline plot simulating the variation of those characteristics over time for a similar injector relying on just the spring 78 to return the check 69. FIG. 3 shows an exemplary plot A and baseline plot B of simulated check 69 displacement D, measured in millimeters. FIG. 4 shows an exemplary plot C and a baseline plot E of the simulated volumetric displacement F, measured in liters per minute. FIG. 5 shows an exemplary plot G and a baseline plot H of simulated pressure, P, measured in kPa, within the spring cavity 48. It is readily evident that the present invention achieves the desired gradual increase to the maximum displacement, followed by a rapid return to the first position with the seat pressing against the first end 55 of the cavity 66.

Various parameters control the effectiveness of the trapped volume nozzle. As noted above, $dP=E_b(dV/Vo)$. Anticipated values of these parameters are:

$Vo=350\ mm^3$ (0.021 $in^3$)
$E_b=1724$ MPa (250,000 psi)
Guide portion diameter=4.6 mm (0.18 inches)
Guide portion stroke=0.35 mm (0.014 inches)
$dV_{max}$0.35 mm $(\pi/4)$ $(4.6\ mm)^2=5.8\ mm^3$ (0.00035 $in^3$)
$dP_{max}=1724$ MPa$(5.8\ mm^3/350\ mm^3)=28.6$ MPa (4140 psi)

FIG. 5 indicates a maximum change in pressure, however, of only 21 MPa, less than the 28.6 MPa calculated above. This variance is accounted for by leakage of fuel through the annular clearance between the guide passage 65 and the guide portion 70. Leakage increases with a greater annular clearance. Leakage also tends to increase as the length of overlap between the guide portion 70 and the guide passages 65 decreases. Leakage additionally increases with an increase in the difference in pressures of the spring chamber, or trapped volume 48, and the injection chamber 64.

Given a fixed available stroke, the maximum pressure change $dP_{max}$ produced in the spring chamber 48 does not vary directly with the pressure of the injection chamber 64, as in Grgurich where the pressure in the spring chamber essentially equals pressure in the injection chamber 64. Instead, the pressure change is controlled by the available change in volume $dV_{max}$.

It should be appreciated that although this invention is described in the context of a HEUI unit fuel injector, it is equally applicable to nonunitized HEUI fuel injectors as well as mechanically-actuated fuel injectors. This invention is well suited for use with any high pressure fuel injectors employing a movable check 69.

It should also be appreciated that because of the beneficial effect of using a relatively small volume spring chamber 48 on the ability to increase fluid pressure within the spring chamber 48, it is possible to design fuel injector nozzles having a relatively short spring chamber thereby decreasing the overall length of a fuel injector 10.

Other aspects, objects, and advantages of this invention can be obtained from a study of the drawings, the disclosure and the appended claims.

I claim:

1. A fuel injector nozzle adapted to be in fluid communication with a source of a limited volume of highly pressurized liquid, comprising:

a guiding member having a closed cavity on a first axis;

a check partially disposed in the closed cavity and for axial displacement therein trapping liquid therein and having a first end portion extending from the closed cavity; and the guiding member including at an end thereof a spray tip surrounding the first end portion of the check and defining a cavity adapted to be in fluid communication with the source of highly pressurized liquid and surrounding the first end portion of the check with the first end portion in a first position engaging the spray tip and blocking an orifice defined through the tip wherein an introduction of highly pressurized liquid into the cavity axially displaces the check from the first position with a resultant increase in pressure within the closed cavity returning the check to the first position when the limited volume of highly pressurized liquid has been exhausted.

2. A fuel injector nozzle adapted to be in fluid communication with a source of a limited volume of highly pressurized liquid, comprising:

a nozzle housing defining therein a cavity on a first axis closed on one end;

a check slidably disposed in the cavity for axial displacement therein trapping liquid in the closed end of the cavity and having a first end portion extending away from the closed cavity; and the nozzle housing including a spray tip surrounding the first end portion of the check and defining a portion of the cavity adapted to be in fluid communication with the source of highly pressurized liquid and surrounding the first end portion of the check with the first end portion in a first position engaging the spray tip and blocking an orifice defined through the tip wherein an introduction of highly pressurized liquid into the cavity axially displaces the check from the first position with a resultant increase in pressure within the closed cavity returning the check to the first position when the limited volume of highly pressurized liquid has been exhausted.

* * * * *